US006328819B1

(12) United States Patent
Lerche et al.

(10) Patent No.: US 6,328,819 B1
(45) Date of Patent: Dec. 11, 2001

(54) METHOD AND USE OF AN APPARATUS FOR THE THERMAL TREATMENT, IN PARTICULAR NITRIDING TREATMENT, OF METAL WORKPIECES

(75) Inventors: Wolfgang Lerche; Bernd Edenhofer; Michael Lohrmann, all of Kleve (DE)

(73) Assignee: Ipsen International GmbH (DE)

( * ) Notice: Subject to any disclaimer, the term of this patent is extended or adjusted under 35 U.S.C. 154(b) by 0 days.

(21) Appl. No.: 09/562,695

(22) Filed: Apr. 28, 2000

(30) Foreign Application Priority Data

Feb. 4, 2000 (DE) ..... 00 10 2359

(51) Int. Cl.[7] ..... C23C 8/24

(52) U.S. Cl. ..... 148/238; 148/216; 148/217; 148/218; 148/225

(58) Field of Search ..... 148/206, 216, 148/217, 218, 225, 238

(56) References Cited

U.S. PATENT DOCUMENTS 3,748,195 * 7/1973 Kondo et al. ..... 148/16.5
4,496,401 * 1/1985 Dawes et al. ..... 148/16.5
4,531,984 * 7/1985 Madsac et al. ..... 148/16.6
5,022,934 * 6/1991 Schwing et al. ..... 148/16.5
5,037,491 * 8/1991 Fox ..... 148/16.5

* cited by examiner

*Primary Examiner*—Roy King
*Assistant Examiner*—Nicole Coy
(74) *Attorney, Agent, or Firm*—R. W. Becker & Associates; R. W. Becker

(57) ABSTRACT

A method is provided for heat treatment of metal workpieces obtain a substantially uniform nitride layer, even in workpieces comprising high alloy iron articles. The following method steps are provided:

a) heating the workpieces to a temperature between 400° C. and 500° C. in a gas atmosphere comprising only ammonia;

b) continuing to heat the workpieces to a temperature between 500° C. and 700° C. in a gas atmosphere containing ammonia and an added oxidizing agent;

c) maintaining the workpieces at this temperature and in this gas atmosphere for a period of between 0.1 hour and 5 hours;

d) continuing to maintain the workpieces at this temperature for a period of between 1 hour and 100 hours in a gas atmosphere containing ammonia or containing ammonia and a carbon-releasing substance; and, e) cooling the workpieces to room temperature.

7 Claims, 1 Drawing Sheet

METHOD AND USE OF AN APPARATUS FOR THE THERMAL TREATMENT, IN PARTICULAR NITRIDING TREATMENT, OF METAL WORKPIECES

BACKGROUND OF THE INVENTION

The present invention relates to a method for thermal treatment of metal workpieces, in particular for nitriding or nitrocarburizing iron alloy articles such as high alloy steels. The invention furthermore relates to the use of an apparatus for performing such a method.

Metal workpieces are subjected to a thermochemical heat treatment for producing defined workpiece properties, e.g. high resistance to wear or sufficient corrosion resistance. In nitriding and nitrocarburizing, the result of the heat treatment is that the case of the workpiece is enriched with nitrogen and/or carbon in order to provide the workpiece with the required mechanical and chemical properties at the surface and in the case.

In nitriding, e.g. in a gas atmosphere containing ammonia, the surface layer or case is enriched with nitrogen in that the ammonia ($NH_3$) contained in a reaction gas generally breaks down into nitrogen (N) and hydrogen (H) at temperatures greater than 500° C. under the catalytic effects of the surface of the workpieces that are to be subjected to nitriding. The ammonia molecule is adsorbed and gradually broken down at the workpiece surface, whereby the required nitrogen is released in its atomic form and is available for dissolving in the iron and for forming iron nitride ($Fe_xN$). In nitrocarburizing, in addition, the case is simultaneously enriched with carbon. Atomic carbon (C) diffuses through the surface of the workpiece into the case in an analogous manner.

In general, the case is of particular importance in terms of the properties the treated workpieces must have. In addition to hexagonal $\epsilon$-nitride ($Fe_{2-3}N$), it can also have cubic face-centered $\gamma'$-nitride ($Fe_4N$) and furthermore can have nitrides from nitride-forming alloy elements, e.g. chromium nitride, molybdenum nitride, manganese nitride, titanium nitride, niobium nitride, tungsten nitride, vanadium nitride, and aluminum nitride.

In particular with chromium and/or nickel alloy iron articles, as the content of the alloy elements increases, more passivation occurs that manifests itself, e.g., in local variations in hardening, known as soft spots. Passivation makes it more difficult for the nitrogen to transition from the gas phase into the material as described in the foregoing; consequently the results of subsequent nitriding or nitrocarburizing are limited.

Known in prior art therefore are a number of methods for influencing the surface condition of workpieces in terms of effecting an improved nitriding or nitrocarburizing result. For instance, a series of articles by H. Sidan points out that satisfactory nitriding of highly alloyed iron articles (which are consequently inclined to passivation) requires the passive layer to be destroyed ("Nitriding Rust-Proof and Acid-Proof Steels", *Technische Rundschau* (1966) 24, p. 913 ff., *Technische Rundschau* (1966) 28 pp. 3–7, *Technische Rundschau* (1966) 42, pp. 33 –37 and 45). Additional known measures are, e.g. pre-oxidizing or oxinitriding. In the latter, an oxygen carrier is added to a reaction gas, which results in exterior oxidation of the treated workpieces. Depending on the composition of the reaction gas used, during the further course of nitriding $Fe_3O_4$ layers form that are permeable for nitrogen and lead to the destruction of any passive layers. Usage of the activating effect of oxidizing gasses on nitrogen absorption in highly alloyed iron articles, e.g. stainless steels, is covered, e.g. by Spies, et. al., in their article entitled "Gas Oxinitriding of High Alloy Steels", *HTM* 52 (1997) 6, pp. 342–349. On the other hand, in an essay by Stiles et. al., the authors suggest heating high chromium content steels in the absence of oxygen in a reducing atmosphere ("Accelerating the Gas Nitriding Process by Pretreating in the Reactive Gas Phase", *HTM* 53, (1998) 4, pp. 211 through 219).

However, the disadvantage of all of these measures is either that the nitride layer produced by nitriding or nitrocarburizing is not sufficiently uniform or that conditions for forming the nitride layer are required that are technically unfeasible or would be very difficult to attain.

The object of the invention is therefore to create a method for heat treating metal workpieces in which a substantially uniform nitride layer can be obtained even in workpieces made of highly alloyed iron articles.

BRIEF DESCRIPTION OF THE DRAWING

This object, and other objects and advantages of the present invention will appear more clearly from the following specification in conjunction with the accompanying drawing, in which.

SUMMARY OF THE INVENTION

Figure 1:
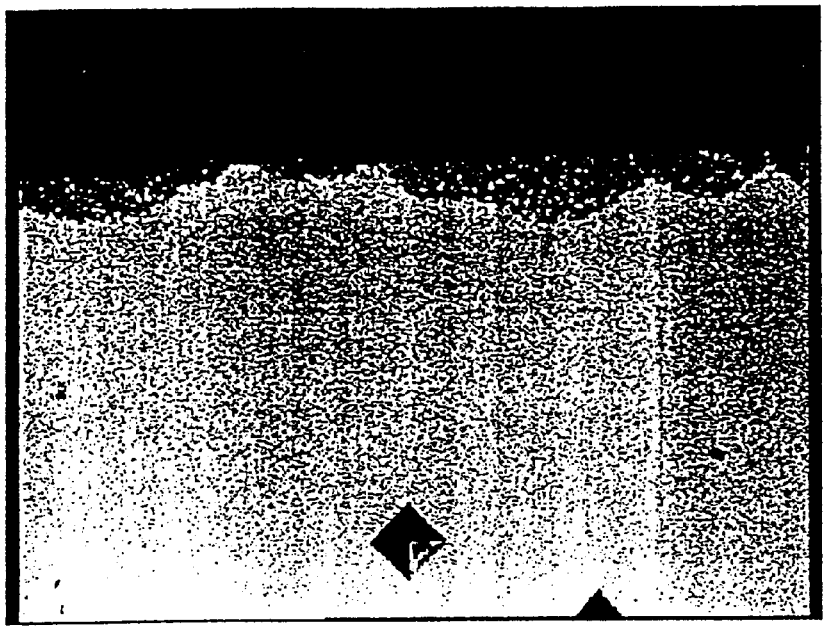
FIG. 1 is a micrograph that shows the structure of a workpiece sample after conventional nitriding treatment.

This method of the present invention is characterized primarily by the following steps:

a) heating the workpieces in a nitriding furnace to a temperature between 400° C. and 500° C. in a gas atmosphere containing ammonia;

b) continuing to heat the workpieces to a temperature between 500° C. and 700° C. in a gas atmosphere containing ammonia and an added oxidizing agent;

c) maintaining the workpieces at this temperature and in this gas atmosphere for a period of between 0.1 hour and 5 hours;

d) continuing to maintain the workpieces at this temperature for a period of between 1 hour and 100 hours in a gas atmosphere containing ammonia or containing ammonia and a carbon-releasing substance; and, e) cooling the workpieces to room temperature.

The surprising result of such a method is that a substantially uniform nitride layer can be obtained if, prior to the actual heat treatment in method step d, for instance nitriding or nitrocarburizing, the workpieces are first pre-heated in a gas atmosphere containing only ammonia and are then heated to the treatment temperature in a gas atmosphere that additionally contains an oxidizing agent, and finally are maintained for a certain period at this temperature, the result being that potential passive layers in high alloy materials are eliminated or transformed such that uniform diffusion of the nitrogen into the material is promoted. The temperature to which the workpieces are heated in each of the various method steps, and the period for which they are maintained in each of the gas atmospheres, depend on the composition of the reaction gas, the material of the workpieces to be treated, and the desired treatment results.

It has proved particularly advantageous to add air, carbon dioxide ($CO_2$), water vapor $(H_2O)_v$, or nitrous oxide ($N_2$0)

as the oxidizing agent. The ratio of the amount of ammonia to oxidizing agent in the gas atmosphere is between 1:1 and 5:1 if air is used as the oxidizing agent; the ratio is between 1:0.1 and 1:1 if carbon dioxide, water vapor, or nitrous oxide is used as the oxidizing agent.

A particularly advantageous method results if the period for continuing to maintain the workpieces in a gas atmosphere containing ammonia, or containing ammonia and a carbon-releasing substance, is selected depending on the desired thickness of the case to be enriched.

With regard to a method corresponding to the required workpiece properties, it can also be useful to use carbon dioxide, carbon monoxide, or hydrocarbons, individually or in a mixture, as the carbon-releasing substances. The invention also suggests that the workpieces be cooled to room temperature in a reducing or neutral gas atmosphere, e.g. comprising an endothermic gas or nitrogen, or that they be cooled to room temperature in a liquid quenching medium, in order to ensure an economically favorable method.

Finally, use of an apparatus for conducting such a method is suggested that comprises a heat treatment furnace with a heatable, gas-tight inner chamber for nitriding or nitrocarburizing metal workpieces, and furthermore comprises a device for the metered addition of ammonia, a carbon-releasing substance, and an oxidizing agent.

Further details of the present invention will be described in detail subsequently.

DESCRIPTION OF PREFERRED EMBODIMENTS

Figure 2:
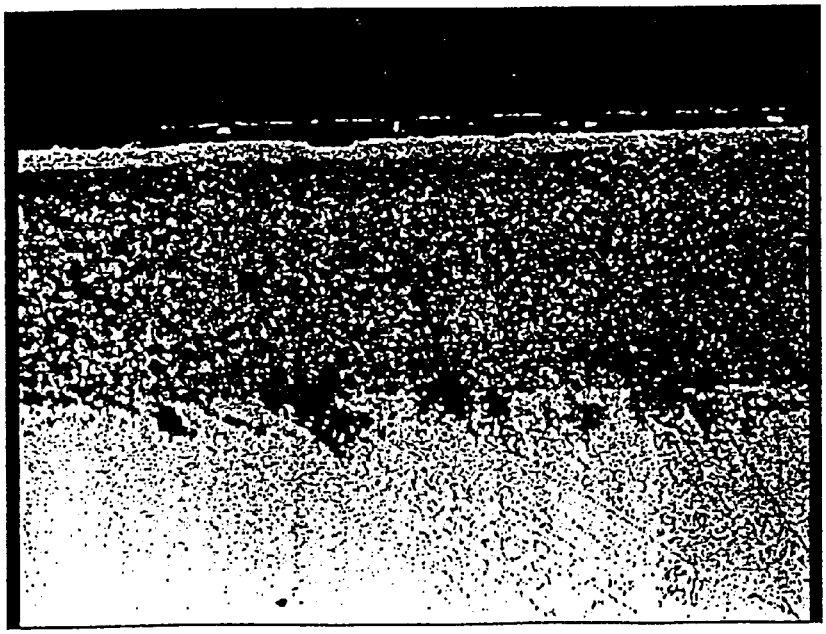
FIG. 2 is a micrograph like that in FIG. 1 of a workpiece sample after treatment with the method in accordance with the invention.

Referring now to the drawing in detail, FIGS. 1 and 2 are 200× enlargements of two sample workpieces that have undergone nitriding and were subsequently subjected to metallographic examination. For a comparative analysis of the uniformity of the nitride layers produced, the two identical sample workpieces made of X 30 Cr 13 steel (Material no. 1.4028) underwent nitriding at a nitriding temperature of approx. 580° C. in an ammonia-containing gas atmosphere in a batch furnace whose oven chamber had been rinsed in advance at room temperature with an endothermic gas.

The first sample workpiece, shown in FIG. 1, was first pre-heated to a temperature of approx. 450 ° C. in a gas atmosphere containing endothermic gas and was then heated to the nitriding temperature of approx. 580 ° C. in a reaction gas comprising 50 vol. % ammonia ($NH_3$) and 50 vol. % endothermic gas. After approx. 240 minutes, during which the sample workpiece was exposed to the gas atmosphere at this temperature, the sample workpiece was cooled to room temperature in a gas atmosphere containing endothermic gas.

In contrast, the second sample workpiece, shown in FIG. 2, was first preheated to a temperature of approx. 450° C. in an ammonia-containing gas atmosphere and was then heated to the nitriding temperature of approx. 580° C. in an ammonia-containing reaction gas to which air was added as an oxidizing agent at a ratio of 3.5 (ammonia): 1 (air). The sample workpiece was then maintained at this temperature and in this gas atmosphere for a period of approx. 1.5 hours. Then the gas atmosphere was exchanged and the sample workpiece was exposed to a reaction gas with a composition of 50 vol. % ammonia ($NH_3$) and 50 vol. % endothermic gas at 580° C. for approx. 4 hours in order to achieve the desired nitriding depth of approx. 8 $\mu$m. Finally the second sample workpiece was then also cooled to room temperature in a gas atmosphere containing endothermic gas.

Comparison of the micrographs in the figures demonstrates that the structure of the first sample workpiece, produced by conventional nitriding, has an uneven nitride layer in the range of 0 $\mu$m to 40 $\mu$m distance from the edge, while the nitride layer of the second sample workpiece, produced using the second method described, is substantially more uniform.

In addition, highly alloyed iron articles like stainless steel, whose high resistance to corrosion is directly related to surface passivation, can obtain better treatment results in a relatively simple manner.

The specification incorporates by reference the disclosure of European priority document EP 00 10 2359.7 filed Feb. 4, 2000.

The present invention is, of course, in no way restricted to the specific disclosure of the specification and drawings, but also encompasses any modifications within the scope of the appended claims.

What we claim is:

1. A method for thermal treatment of metallic workpieces, said method including the steps of:

a) heating the workpieces in a heat treatment furnace to a first temperature of between 400 and 500° C. in a gas atmosphere comprising only ammonia;

b) continuing to heat the workpieces to a second temperature of between 500 and 700° C. in a gas atmosphere comprising ammonia and an added oxidizing agent;

c) maintaining the workpieces at said second temperature and in this gas atmosphere of step b) for a period of between 0.1 and 5 hours;

d) continuing to maintain the workpieces at said second temperature for a period of between 1 and 100 hours in a gas atmosphere that contains ammonia or that contains ammonia and a carbon-releasing substance; and e) cooling the workpieces to room temperature.

2. A method according to claim 1, wherein said oxiding agent of step b) is selected from the group consisting of air, carbon dioxide, water vapor, and nitrous oxide.

3. A method according to claim 2, wherein a ratio of the quantity of ammonia to oxidizing agent in the gas atmosphere is between 1:1 and 5:1 if air is used as the oxidizing agent, and between 1:0.1 and 1:1 if carbon dioxide, water vapor or nitrous oxide is used as the oxidizing agent.

4. A method according to claim 1, which includes the step of selecting the period for continuing to maintain the workpieces in a gas atmosphere containing ammonia, or containing ammonia and a carbon-releasing substance, as a function of a desired thickness of a case of a workpiece to be enriched.

5. A method according to claim 1, wherein said carbon-releasing substance of step d) is selected from the group consisting of carbon dioxide, carbon monoxide, hydrocarbons, and a mixture thereof.

6. A method according to claim 1, wherein said step of cooling the workpieces to room temperature comprises cooling said workpieces in a reducing or neutral gas atmosphere, or in a liquid quenching medium.

7. A method according to claim 6, wherein said reducing or neutral gas atmosphere is an endothermic gas or nitrogen.

* * * * *